US010273641B2

(12) United States Patent
Fernandez Lopez

(10) Patent No.: US 10,273,641 B2
(45) Date of Patent: Apr. 30, 2019

(54) EQUIPMENT FOR CONCRETING AND MOULDING GUTTERS

(71) Applicant: Gonzalo Fernandez Lopez, Boo de Piélagos (ES)

(72) Inventor: Gonzalo Fernandez Lopez, Boo de Piélagos (ES)

( * ) Notice: Subject to any disclaimer, the term of this patent is extended or adjusted under 35 U.S.C. 154(b) by 632 days.

(21) Appl. No.: 15/307,906

(22) PCT Filed: Feb. 19, 2013

(86) PCT No.: PCT/ES2013/070100
§ 371 (c)(1),
(2) Date: Oct. 31, 2016

(87) PCT Pub. No.: WO2014/128312
PCT Pub. Date: Aug. 28, 2014

(65) Prior Publication Data

US 2017/0081811 A1 Mar. 23, 2017

(51) Int. Cl.
*E01C 11/22* (2006.01)
*E01C 19/48* (2006.01)
*E01C 19/42* (2006.01)

(52) U.S. Cl.
CPC ..... *E01C 19/4893* (2013.01); *E01C 19/42* (2013.01); *E01C 2301/02* (2013.01)

(58) Field of Classification Search
CPC ..... E01C 19/22; E01C 19/42; E01C 19/4866; E01C 19/4873; E01C 19/4886; E01C 19/4893
(Continued)

(56) References Cited

U.S. PATENT DOCUMENTS 940,061 A 11/1909 Ransome
1,334,483 A * 3/1920 Brooks ..... E01C 19/44 404/98
(Continued)

FOREIGN PATENT DOCUMENTS

ES 1056962 U 6/2004
ES 2315098 A1 3/2009
(Continued)

OTHER PUBLICATIONS

International Search Report and Written Opinion dated Oct. 30, 2013 for International Application No. PCT/ES2013/070100 from Spain Patent & Trademark Office, pp. 1-12, Madrid, Spain.
(Continued)

*Primary Examiner* — Thomas B Will
*Assistant Examiner* — Katherine J Chu
(74) *Attorney, Agent, or Firm* — Sherman IP LLP; Kenneth L. Sherman; Steven Laut

(57) ABSTRACT

A device for concreting and molding gutters includes runners configured to slide over ground. A mold forms the concavity of a gutter and a hopper, with a closure for pouring of concrete into a trench previously excavated in a form of the gutter. The runners have an extendable, rear extension configured to be raised and lowered by a hydraulic cylinder, with the runners further including sides. The sides forming lateral parts of a concreting hopper and a means of attachment for vibrators for vibrating the concrete. The mold includes a structure for attachment to the sides of the runners and to an arm of a backhoe or tow machine, with the mold structure complemented by plates, attached using hinges to the structure of the mold and using pipe turnbuckles, enabling variation of inclination of the mold.

2 Claims, 4 Drawing Sheets

(58) Field of Classification Search
USPC ..... 404/96, 98, 118, 97
See application file for complete search history.

(56) References Cited

U.S. PATENT DOCUMENTS 2,089,094 A * 8/1937 Kime ..... E01C 19/15 404/104
2,885,861 A * 5/1959 Jackson ..... E01C 19/40 404/96
3,429,130 A * 2/1969 Alfred ..... E01C 19/4853 404/105
3,600,773 A * 8/1971 Davis ..... E01C 19/4893 249/2
3,733,140 A * 5/1973 James, III ..... E01C 19/4893 404/98
4,027,990 A 6/1977 Merrill
4,068,969 A * 1/1978 Beach ..... E01C 19/488 404/104
4,217,065 A * 8/1980 Stilwell ..... E01C 19/4886 404/98
4,557,633 A * 12/1985 Dyck ..... E02B 13/00 404/100
4,802,788 A * 2/1989 Smith ..... E01C 23/24 404/105
5,470,175 A * 11/1995 Jensen ..... E01C 19/15 404/108
5,533,831 A * 7/1996 Allen ..... E01C 19/006 404/114
6,286,436 B1 * 9/2001 Sansalone ..... E01C 19/484 105/247
6,709,195 B2 * 3/2004 Piccoli ..... E01C 19/4893 404/98
6,799,922 B2 * 10/2004 Smith ..... E01C 23/07 404/75
6,817,849 B1 * 11/2004 Taylor ..... E01C 19/4893 404/105
8,333,533 B1 * 12/2012 Fiorina ..... E01C 19/4893 404/105
9,926,678 B2 * 3/2018 Vogel ..... E01C 19/4873
2002/0106242 A1 * 8/2002 Rahn ..... E01C 19/42 404/96

FOREIGN PATENT DOCUMENTS

JP 58210217 A 12/1983
WO WO-2014128312 A1 * 8/2014 ..... E01C 19/4893

OTHER PUBLICATIONS

International Preliminary Report on Patentability dated Aug. 25, 2015 for International Application No. PCT/ES2013/070100 from the IB of WIPO, pp. 1-10, Geneva, Switzerland.

* cited by examiner

EQUIPMENT FOR CONCRETING AND MOULDING GUTTERS

PURPOSE OF THE INVENTION

This invention refers to equipment for the concreting and moulding gutters. These operations are carried out in situ in order to concrete a gutter with a perfect finish through the application of a mould, through which concrete is poured into the trench by means of the hopper of the equipment.

BACKGROUND OF THE INVENTION

There are numerous types of devices and machines to construct gutters, specifically for previously excavated trenches so as to obtain the final gutter. These machines or items of equipment are commonly towed by a backhoe or similar vehicle, with the concreting machine sliding along the trench in order to construct the gutter.

Generally, this type of concreting machine is equipped with runners, a mould to make the gutter form or concavity and, logically, a hopper with concrete to be poured progressively into the previously excavated trench.

Nevertheless, the structure of these types of machines for the construction of gutters is complex. Moreover, each machine is designed to construct a specified type of gutter; a different machine must be used for each gutter configuration. This obviously requires the availability of different units to construct different gutter shapes, unless all the gutters are made in exactly the same way, in which case, logically, a single machine is used. In most cases, as is known, specific gutter configurations are required for each location, making it impossible to use a specific type of machine.

DESCRIPTION OF THE INVENTION

The equipment for concreting and moulding gutters in situ, as per this invention, offers structural features which resolve the aforementioned problems.

More specifically, the equipment of this invention is based on retaining the runners, but with the ability to independently assemble and disassemble the part corresponding to the mould and the part corresponding to the hopper and its closure. This enables construction of gutters with different configurations by simply interchanging the mould and concreting hopper or closure.

Another novel feature is that the runners are equipped with a hydraulically-actuated rear longitudinal extension to provide additional support in certain circumstances by increasing and/or decreasing the length of the runners.

Additionally, each runner is equipped with a fixed side to facilitate attachment of the corresponding mould, while forming the side of the hopper, also constituting a means of attachment for conventional vibrators, which this type of concreting machine for forming gutters incorporates.

Said side fitted to each runner for the attachment of the mould, and forming the side of the hopper, is connected to the runner using hinges and a set of hydraulic cylinders enabling variation of the inclination to a greater or lesser extent toward the exterior of said side.

Furthermore, the mould is comprised of two parts, one of which constitutes the structure for attachment to the runners, serving also as a connection to the backhoe arm. This structure for attachment also forms the rear part of the hopper through which concrete is poured. The other part of the mould comprises a set of plates representing the gutter configuration. These plates are welded to the structure of the mould, with thinner plate extensions using concealed hinges, as well as attachment to the structure of said mould using pipe turnbuckles that enable variation of the final inclination of the plane. This compresses the concrete to achieve a smoother finish of the gutter surface.

Finally, the hopper corresponding to the concreting equipment is complemented by a closure constructed of two steel plates; one fixed, screwed to the side of the runners, and one movable, connected to the fixed plate by means of a double-acting hydraulic cylinder, enabling it to be raised and lowered using guides welded to the sides of each runner.

Clearly, the movable plate will have the gutter shape in its bottom face and is equipped with a type of elastic skirting to adapt to the irregularities of the trench as the equipment slides. This enables the hydraulic cylinder connecting the movable part of the closure to raise and lower the latter over the level of the moulded gutter, while enabling reverse movement to touch up the mould.

In this way, when the equipment is towed by the backhoe, concrete is poured into the previously excavated trench. Said concrete is vibrated with the use of hydraulic vibrators fitted to the sides of each runner for this purpose. All the above is so that when the mould passes over the vibrated concrete, it leaves a perfect smooth finish without pores.

The interchangeability of the mould and, where appropriate, the hopper or its closure, enable interchanging for different elements, thus obtaining different gutter configurations.

DESCRIPTION OF THE DRAWINGS

To complement the description to be given below and to aid better understanding of the features of the invention, in accordance with a preferred practical embodiment, and as an integral part of said description, a set of illustrative, non-limiting drawings is provided.

PREFERRED EMBODIMENT OF THE INVENTION

As shown in the aforementioned figures, the equipment of this invention comprises three differentiated, removable parts, with one of the parts being the lateral runners (1) for sliding the equipment over the ground; the second part being the mould (2) to form the gutter itself; and the third part being the concreting hopper (3), equipped with a closure (4), the characteristics of which are explained below.

Figure 6:
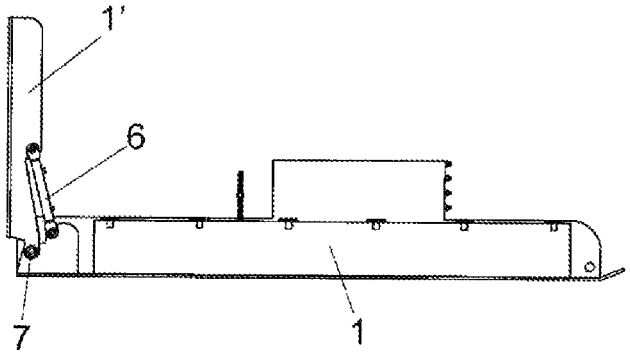
FIG. 6—Shows a side view of a runner with the rear extension in the raised position.

Each runner (1) is manufactured in steel with the raised front or attack part (5) enabling perfect sliding, while the rear part includes a longitudinal extension (l') driven by a hydraulic cylinder (6) in order to increase or decrease the length of the runner (1) itself FIG. 6 shows the extension (l') in the raised position, by revolving around a rotary shaft (7) between the runner (1) and said extension (l').

Furthermore, each runner (1) is equipped with a side (8) to facilitate attachment of the corresponding mould (2), at the same time as forming the side of the concreting hopper (3), serving also as an attachment for a vibrating element (9).

Figure 4:
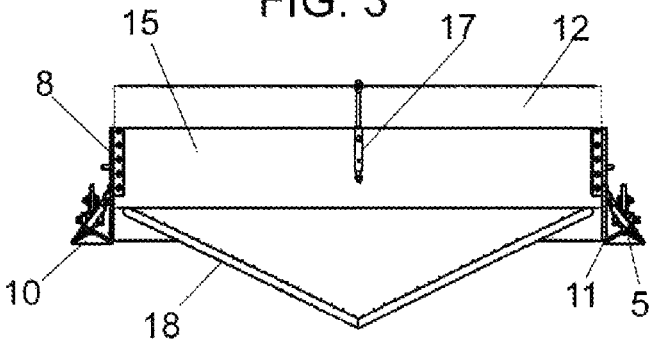
FIGS. 4 and 5—Show front and rear views of the equipment represented in the previous figures.
Figure 5:
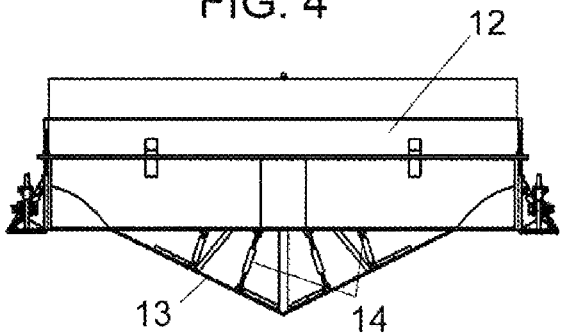

The side (8) is connected to the runner (1) using hinges and a set of hydraulic cylinders enabling variation of the inclination of the former. FIGS. 4 and 5 show the hydraulic cylinders (10) and hinges (11) between the runner (1) and its side (8).

The mould (2) is constituted of a steel plate with the shape and dimensions of the gutter to be moulded, comprising a structure (12) for attachment to the corresponding runners (1) and to the arm of the backhoe (detailed in a later section), the structure (12) of which also forms the rear wall of the hopper (3) through which concrete is poured.

In addition to this structure (12), the mould comprises a set of steel plates with the exact shape of the gutter, welded to said structure (12), with thinner plate extensions (13) also attached to said structure (12) of the mould using pipe turnbuckles (14), enabling variation of the final inclination of the plane.

Figure 1:
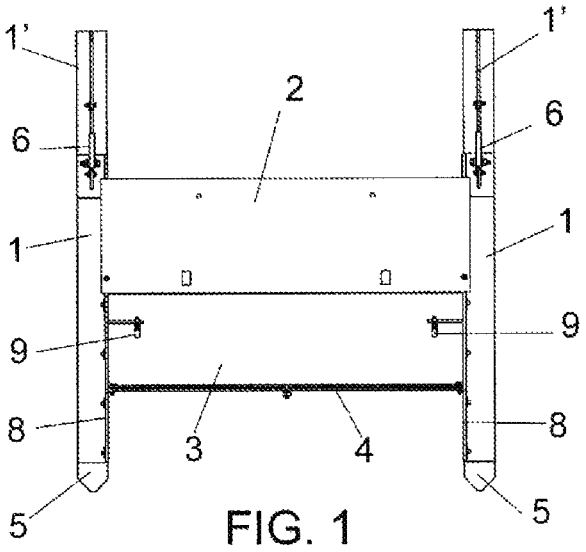
FIG. 1—Shows an top plan view of the equipment for concreting and moulding gutters in situ, embodied in accordance with the purpose of the invention.
Figure 2:
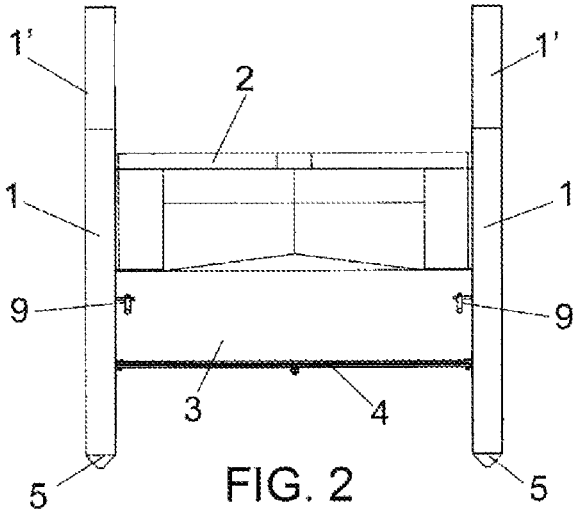
FIG. 2—Shows a bottom plan view of the same equipment as represented in the previous figure.
Figure 3:
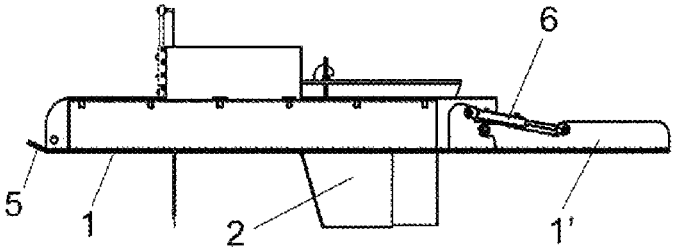
FIG. 3—Shows a side elevation view of said equipment.

FIGS. 2, 4 and 5 clearly show the structure of the mould to form the gutter.

Figure 7:
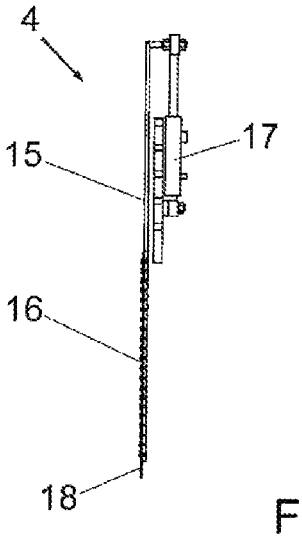
FIG. 7—Shows a side view of the hopper closure that constitutes a part of the equipment for concreting and moulding gutters which is the subject matter of this invention.

Said structure comprises a set of steel plates; one fixed (15), screwed to the respective side (8) of the runners (1) as a hopper closure and another movable plate (16) which is able to raise and lower driven by a hydraulic cylinder (17), as shown in FIG. 7. This cylinder (17) is double acting to enable it to raise and lower the movable plate (16), so opening and closing the hopper to allow the passage of concrete into the gutter trench.

The movable plate (16), with the shape of the gutter on its bottom part, is equipped with a type of elastic skirting (18), approximately 5 cm in height, designed to adapt to the irregularities of the trench during sliding of the equipment through said trench while forming the gutter.

Figure 8:
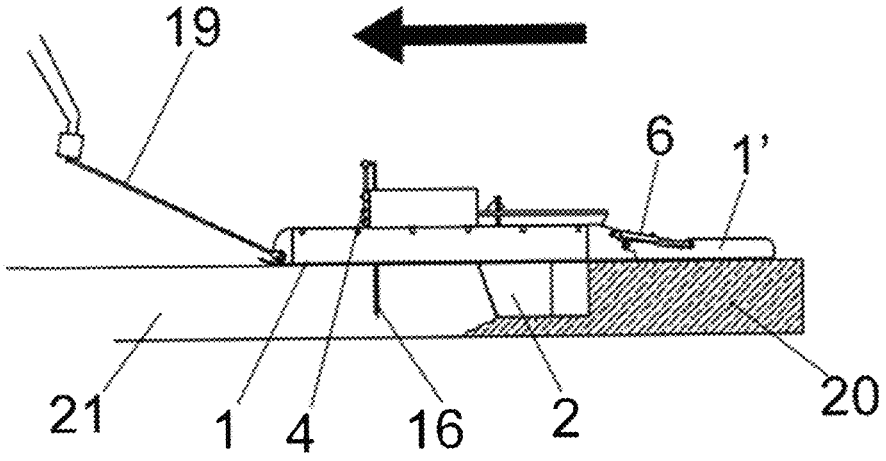
FIGS. 8 and 9—Finally, show side and front elevation views of the equipment in towing operation, forming a gutter.
Figure 9:
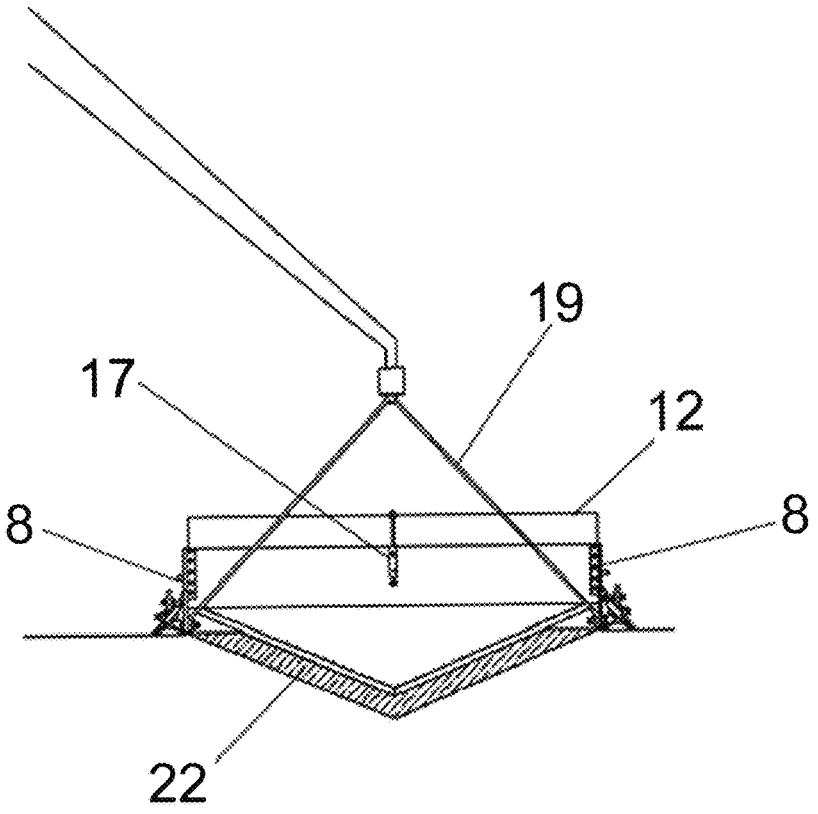

FIGS. 8 and 9 show the equipment in towing operation using chains, rigid steel struts (19) or any specific mechanical coupling device. As shown, the concrete (20) is poured into the excavated trench, referenced by (21). This progressively forms the gutter profile (22) through the forward movement of the mould (2), which is logically carried out via the aforementioned towing of the equipment assembly.

The invention claimed is:

1. A device for concreting and moulding gutters, the device comprising:

a first runner coupled to a first rotatable extension, a first raised front portion, and a first side portion, and the first rotatable extension is coupled to a first hydraulic cylinder that is configured to rotate the first extension with respect to the first runner;

a second runner coupled to a second rotatable extension, a second raised front portion, and a second side portion, and the second rotatable extension is coupled to a second hydraulic cylinder that is configured to rotate the second extension with respect to the second runner, wherein the first runner and the second runner are each slidable over ground; and a mould coupled to the first runner and the second runner, the mould comprising:

a gutter mould including a fixed plate and a moveable plate, the fixed plate coupled to the first side portion and the second side portion, and the moveable plate is coupled to a third hydraulic cylinder, wherein the movable plate is coupled with elastic skirting on a lower edge, and the elastic skirting is configured to adapt to irregularities of an excavated trench through which the device slides; and a hopper including a closure for pouring of concrete into an excavated trench in a form of the gutter mould, wherein the closure is formed by the fixed plate and the movable plate, and the third hydraulic cylinder raises and lowers the movable plate;

wherein the mould is configured to couple to arms of a backhoe or tow machine.

2. The device of claim 1, wherein the first side portion is configured to vary inclination with respect to the first runner, the second side portion is configured to vary inclination with respect to the second runner, and the first side portion and the second side portion are each configured to attach to hydraulic vibrators.

* * * * *